US011365740B2

(12) United States Patent
Masaki et al.

(10) Patent No.: US 11,365,740 B2
(45) Date of Patent: Jun. 21, 2022

(54) CENTRIFUGAL COMPRESSOR FOR USE WITH LOW GLOBAL WARMING POTENTIAL (GWP) REFRIGERANT

(71) Applicant: Daikin Industries, Ltd., Osaka (JP)

(72) Inventors: Kenichi Masaki, St. Louis Park, MN (US); Midori Drake, Minneapolis, MN (US); Jason Busch, Plymouth, MN (US)

(73) Assignee: Daikin Industries, Ltd., Osaka (JP)

( * ) Notice: Subject to any disclaimer, the term of this patent is extended or adjusted under 35 U.S.C. 154(b) by 242 days.

(21) Appl. No.: 16/507,343

(22) Filed: Jul. 10, 2019

(65) Prior Publication Data

US 2021/0010478 A1 Jan. 14, 2021

(51) Int. Cl.

| | |
|---|---|
| ***F04D 17/12*** | (2006.01) |
| ***F04D 29/28*** | (2006.01) |
| ***F25B 31/02*** | (2006.01) |

(52) U.S. Cl.

CPC ..... *F04D 17/122* (2013.01); *F04D 29/286* (2013.01); *F25B 31/026* (2013.01)

(58) Field of Classification Search

CPC ..... F04D 17/122; F04D 29/286; F04D 29/30; F04D 29/284

See application file for complete search history.

(56) References Cited

U.S. PATENT DOCUMENTS

| | | | | |
|---|---|---|---|---|
| 8,308,420 | B2 * | 11/2012 | Yagi | F04D 29/30 415/1 |
| 2017/0198707 | A1 * | 7/2017 | Umeda | F04D 17/12 |
| 2019/0128273 | A1 | 5/2019 | Goldenberg | |

FOREIGN PATENT DOCUMENTS

| | | | |
|---|---|---|---|
| EP | 2 020 509 | A2 | 2/2009 |
| EP | 3 096 022 | A1 | 11/2016 |
| JP | 5483096 | B2 * | 5/2014 |
| JP | 5483096 | B2 | 5/2014 |

(Continued)

OTHER PUBLICATIONS

Journal article titled Development of a Super Efficient Turbo Refrigerant published in the Journal of the Japan Society of Mechanical Engineers; Dec. 2010; vol. 113; No. 1105.

(Continued)

*Primary Examiner* — Sabbir Hasan

(74) *Attorney, Agent, or Firm* — Global IP Counselors, LLP

(57) ABSTRACT

A centrifugal compressor is configured to be used for compressing a low global warming potential (GWP) refrigerant. The centrifugal compressor comprises a casing, an impeller, and a motor for rotating the impeller. The impeller is equipped with blades having a fully nonlinear shape in a quasi-orthogonal cross-sectional view. A hub-side blade angle delta of each of the blades from a hub portion of the first impeller to a mid-span position of the blade varies along a streamwise direction such that the hub-side blade angle delta is largest at a position closer to a leading edge of the first blade than to a trailing edge of the first blade. The casing is configured such that the low global warming potential (GWP) refrigerant enters the impeller from the inlet portion along an axial direction of the impeller and exits the impeller to the outlet portion in a radial direction of the impeller.

17 Claims, 14 Drawing Sheets

(56) References Cited

FOREIGN PATENT DOCUMENTS

WO 99/56022 A1 11/1999

OTHER PUBLICATIONS

The International Search Report and the Written Opinion for the corresponding international application No. PCT/US2019/040970, dated Oct. 2, 2020.
International Preliminary Report on Patentability including Written Opinion for the corresponding international application No. PCT/US2020/040970, dated Jan. 11, 2022.

* cited by examiner

3D Bladed Impeller

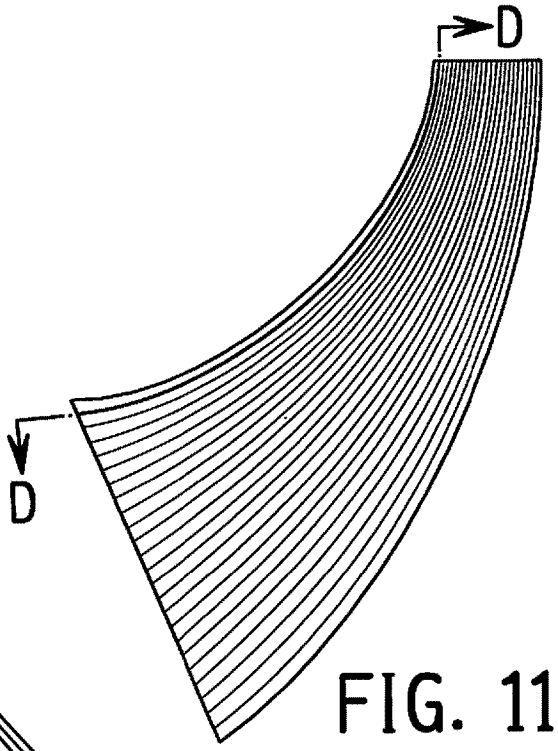
FIG. 11B
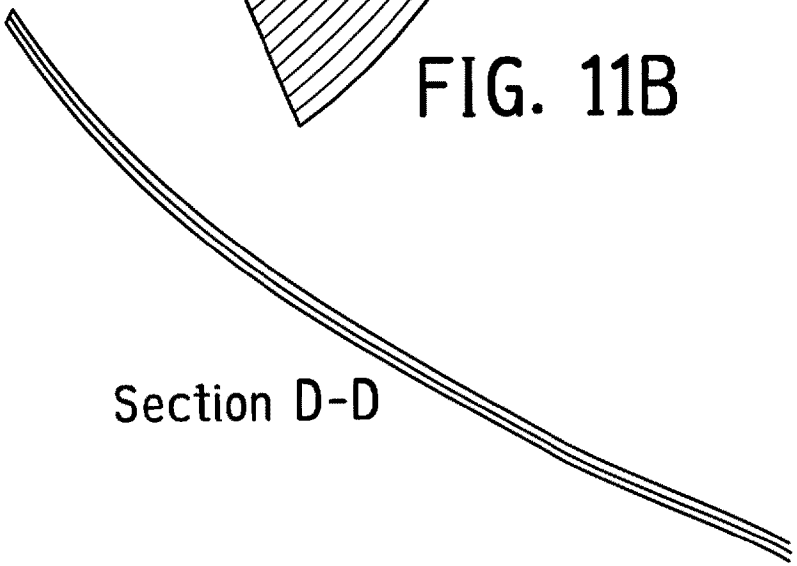
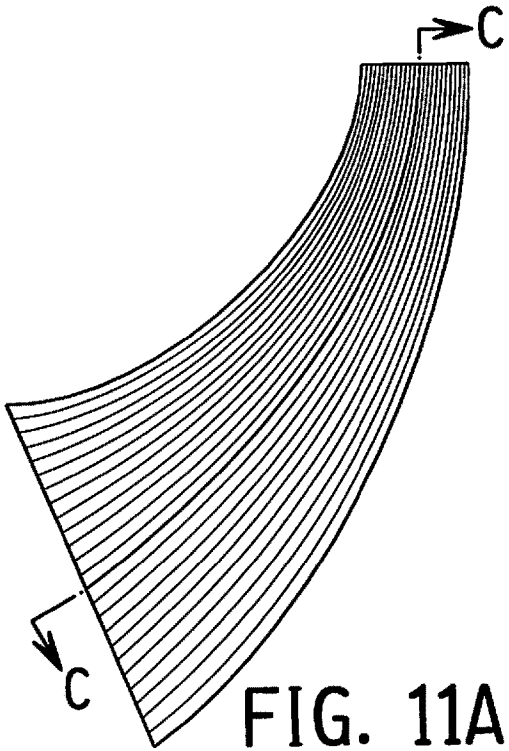
FIG. 11A
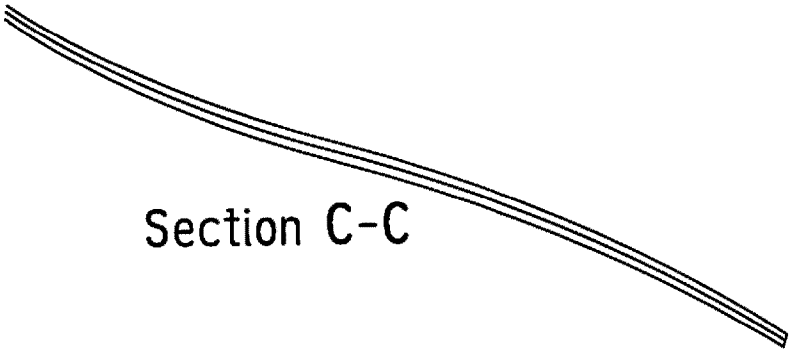

CENTRIFUGAL COMPRESSOR FOR USE WITH LOW GLOBAL WARMING POTENTIAL (GWP) REFRIGERANT

BACKGROUND

Field of the Invention

The present invention generally relates to a centrifugal compressor for use with a low global warming potential (GWP) refrigerant. More specifically, the present invention relates to a centrifugal compressor that has an impeller optimized for use with a low global warming potential (GWP refrigerant) in a chiller circuit.

Background Information

A refrigeration circuit for a chiller system typically includes a compressor to compress a refrigerant as part of a refrigeration cycle. The compressor is often a centrifugal compressor, also called a radial compressor or turbo compressor. A chiller system including a centrifugal compressor is sometimes called a turbo chiller. In a turbo chiller system, refrigerant is compressed in the centrifugal compressor and sent to a heat exchanger in which heat exchange occurs between the refrigerant and a heat exchange medium (liquid). This heat exchanger is referred to as a condenser because the refrigerant condenses in this heat exchanger. As a result, heat is transferred from the refrigerant to the medium (liquid) so that the medium is heated. Refrigerant exiting the condenser is expanded by an expansion valve and sent to another heat exchanger in which heat exchange occurs between the refrigerant and a heat exchange medium (liquid). This heat exchanger is referred to as an evaporator because refrigerant is heated (evaporated) in this heat exchanger. As a result, heat is transferred from the liquid medium (e.g., water, as mentioned above) to the refrigerant, and the liquid is chilled. The refrigerant from the evaporator is then returned to the centrifugal compressor and the cycle is repeated.

A conventional centrifugal compressor basically includes a casing, an inlet guide vane (optional), an impeller, a diffuser, a motor, various sensors and a controller. Refrigerant flows in order through the inlet guide vane, the impeller and the diffuser. Thus, the inlet guide vane is coupled to a gas intake port of the impeller while the diffuser is coupled to a gas outlet port of the impeller. The inlet guide vane controls the flow rate of refrigerant gas into the impeller. The impeller is attached to a shaft that is rotated by the motor. The controller controls the motor, the inlet guide vane and the expansion valve. When the motor rotates the shaft, the impeller rotates inside the casing and increases the velocity of the refrigerant gas flowing into the centrifugal compressor. The diffuser works to transform the velocity of refrigerant gas (dynamic pressure), given by the impeller, into (static) pressure. In this manner, the refrigerant is compressed in a conventional centrifugal compressor. A conventional centrifugal compressor may have one or two stages. A motor drives the one or more impellers.

The impeller of a centrifugal compressor has blades that guide and accelerate the refrigerant as it flows from the inlet guide vanes on an inlet side (gas intake port) of the impeller to the diffuser on an outlet side (gas outlet port) of the impeller. The shape of the blades can be optimized for the particular operating conditions and refrigerant type that will be used in the refrigeration circuit. The blades of impellers used in centrifugal compressors for chiller systems typically have a two-dimensional ("2D") shape. That is, the blade shape of a 2D impeller is defined by planes, cylindrical surfaces, or conical surfaces and, thus, has a linear shape in a hub-to-shroud cross section. 2D impellers are also called "ruled" because the shape of the blades is defined by such specifically shaped surfaces as planes, cylindrical surfaces, and conical surfaces. Due to these definitions or "rules" imposed on the shape of the blades, there are limits to which a 2D blade can be tailored to the particular operating conditions and refrigerant type that will be used in the chiller system.

An impeller blade whose shape is not ruled, i.e., not defined by such simple geometric shapes as planes, cylindrical surfaces, and conical surfaces, is called a fully three-dimensional ("3D") or fully nonlinear blade. 3D impellers have been used in a gas turbine applications, as demonstrated by Japanese Patent No. 5483096 to Nagao.

Meanwhile, there is a trend to transition to so-called "low global warming potential (low GWP)" refrigerants in chiller systems and other HVAC applications to reduce the impact on the environment caused by the release of refrigerants into the atmosphere. GWP is a measure of a greenhouse gas when it is released into the atmosphere and benchmarked against $CO_2$, which is defined to have a GWP equal to one. Thus, GWP is a measure of the potential for a refrigerant or other gas to behave as a greenhouse gas, which can contribute to global warming. The lower the GWP rating (or "GWP value", the lower the potential of the refrigerant to behave as a greenhouse gas when released into the atmosphere. Examples of low-GWP refrigerants for HVAC applications include R1233zd, R1234ze and R1234yf. Each of R1233zd, R1234ze and R1234yf has a global warming potential (GWP)<10. In this application, "low-GWP refrigerant" shall be defined as a refrigerant having a GWP value smaller than 10.

SUMMARY

A number of new refrigerants having a low global warming potential ("low GWP") are coming more widely used in chiller systems and other refrigeration applications due to reduce the impact of refrigerant materials on the environment. In some cases, it is possible simply replace the existing refrigerant with the new low-GWP refrigerant. When this is possible, the new refrigerant is sometimes called a "drop-in replacement" for the old refrigerant. However, in many cases there are trade-offs in performance. For example, R134a (which is not considered to be a low-GWP refrigerant) can be defined to have a coefficient of performance (COP) of 100 and a cooling capacity (CC) of 100. These values can be considered baseline (100%) values as compared to the refrigerants discussed next. Under this definition, R1234yf has a COP of 97 and a CC of 94. R1234ze has a COP of 100 and a CC of 75. R1233zd has a COP of 106 but a CC of only 23. It will be apparent to those skilled in the art from this disclosure that values of COP and CC could vary slightly depending on operating condition. R1234 refrigerants also have no ozone destruction properties and are stable because of the lack of (—Cl). Meanwhile, R1233zd has a very low ozone destruction, but is also less flammable than R1234 refrigerants. One way to compensate for the low CC value of R1233zd, for example, is to rotate the impeller of the compressor faster to obtain more cooling capacity.

Choke and surge are factors that limit the operating range in which a centrifugal compressor can be operated with adequate efficiency. There are several causes for the occurrence of choke and surge in a centrifugal compressor. Choke is a phenomenon that occurs when the centrifugal compressor is operated at or near the maximum mass flow rate that the centrifugal compressor is capable of. Meanwhile, surge is a phenomenon that occurs when the centrifugal compressor is operated at or near the minimum mass flow rate that the centrifugal compressor is capable of. It has been discovered that the operating range in which a centrifugal compressor can be operated without incurring choke or surge conditions can be widened by minimizing flow separation within the blade flow passage. By minimizing flow separation, the losses can be minimized and efficiency can be increased.

Thus, there is a need for centrifugal compressors that are optimized for use with new low-GWP refrigerants in chiller systems and other refrigeration applications in order to optimize the efficiency and operating range of the centrifugal compressor. In view of the state of the known technology, an object of the present invention is to provide a centrifugal compressor having a non-ruled, fully nonlinear impeller that is optimized for use with low-GWP refrigerants in HVAC applications. By using computational fluid dynamics (CFD), the inventors have simulated the flow through a centrifugal compressor at design point mass flow rate as well as at higher mass flow rates (toward choke) and lower mass flow rates (toward surge). In this way, it has been discovered that a centrifugal compressor can be designed to have nearly zero flow separation at the design point mass flow rate and reduced flow separation at higher and lower mass flow rates. In particular, strategies for minimizing flow separation include adjusting the throat area of the centrifugal compressor (i.e., the narrowest area of the impeller inlet) and adjusting the blade curvature at locations where flow separation is found to occur. By using a non-ruled, fully nonlinear impeller blade, the blade curvature can be adjusted with a larger degree of freedom than a conventional 2D blade. Specifically, such features as a hub-side blade angle delta, a shroud-side blade angle delta, a hub-side wrap angle delta, and a shroud-side wrap angle delta can be adjusted. In this way, the shape of the impeller blades can be optimized for a particular low-GWP refrigerant used in a particular chiller system or other HVAC application having particular requirements regarding operating range and efficiency.

More specifically, in accordance with a first aspect of the present disclosure, a centrifugal compressor for use with a low global warming potential (GWP) refrigerant is provided which comprises a casing, a first impeller, and a motor. The casing has a first inlet portion and a first outlet portion. The first impeller is disposed between the first inlet portion and the first outlet portion. The first impeller is attached to a first end of a shaft that is rotatable about a rotation axis. The first impeller is equipped with first blades having a fully nonlinear shape in a quasi-orthogonal cross-sectional view. A hub-side blade angle delta of each of the first blades from a hub portion of the first impeller to a mid-span position of the first blade varies along a streamwise direction such that the hub-side blade angle delta is largest at a position closer to a leading edge of the first blade than to a trailing edge of the first blade. The motor is arranged inside the casing to rotate the shaft in order to rotate the first impeller. The casing is configured such that the low global warming potential (GWP) refrigerant enters the impeller from the first inlet portion along an axial direction of the first impeller and exits the first impeller to the first outlet portion in a radial direction of the first impeller.

In accordance with a second aspect of the present disclosure, a centrifugal compressor for use with a low global warming potential (GWP) refrigerant is provided which comprises a casing, a first impeller, and a motor. The casing has a first inlet portion and a first outlet portion. The first impeller is disposed between the first inlet portion and the first outlet portion. The first impeller is attached to a first end of a shaft that is rotatable about a rotation axis. The first impeller is equipped with first blades having a fully nonlinear shape in a quasi-orthogonal cross-sectional view. A hub-side wrap angle delta of each of the first blades from a hub portion of the first impeller to a mid-span position of the first blade varies along a streamwise direction such that the hub-side wrap angle delta is largest at a position closer to a leading edge of the first blade than to a trailing edge of the first blade. The motor is arranged inside the casing to rotate the shaft in order to rotate the first impeller. The casing is configured such that the low global warming potential (GWP) refrigerant enters the impeller from the first inlet portion along an axial direction of the first impeller and exits the first impeller to the first outlet portion in a radial direction of the first impeller.

In accordance with a third aspect of the present disclosure, a method of producing refrigeration is provided which comprises compressing a low global warming potential (GWP) refrigerant within a chiller system that includes a centrifugal compressor having an impeller attached to a shaft rotatable about a rotation axis. The impeller is equipped with blades having a nonlinear shape in a quasi-orthogonal cross-sectional view. A hub-side blade angle delta of each of the blades from a hub portion of the impeller to a mid-span position of the blade varies along a streamwise direction such that the hub-side blade angle delta is largest at a position closer to a leading edge of the blades than to a trailing edge of the blades.

These and other objects, features, aspects and advantages of the present invention will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure:

FIGS. 11A and 11B illustrate the curvature of the fully nonlinear blade in two different cross sections taken along a longitudinal direction in the meridional plane.

DETAILED DESCRIPTION OF EMBODIMENT(S)

Select embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
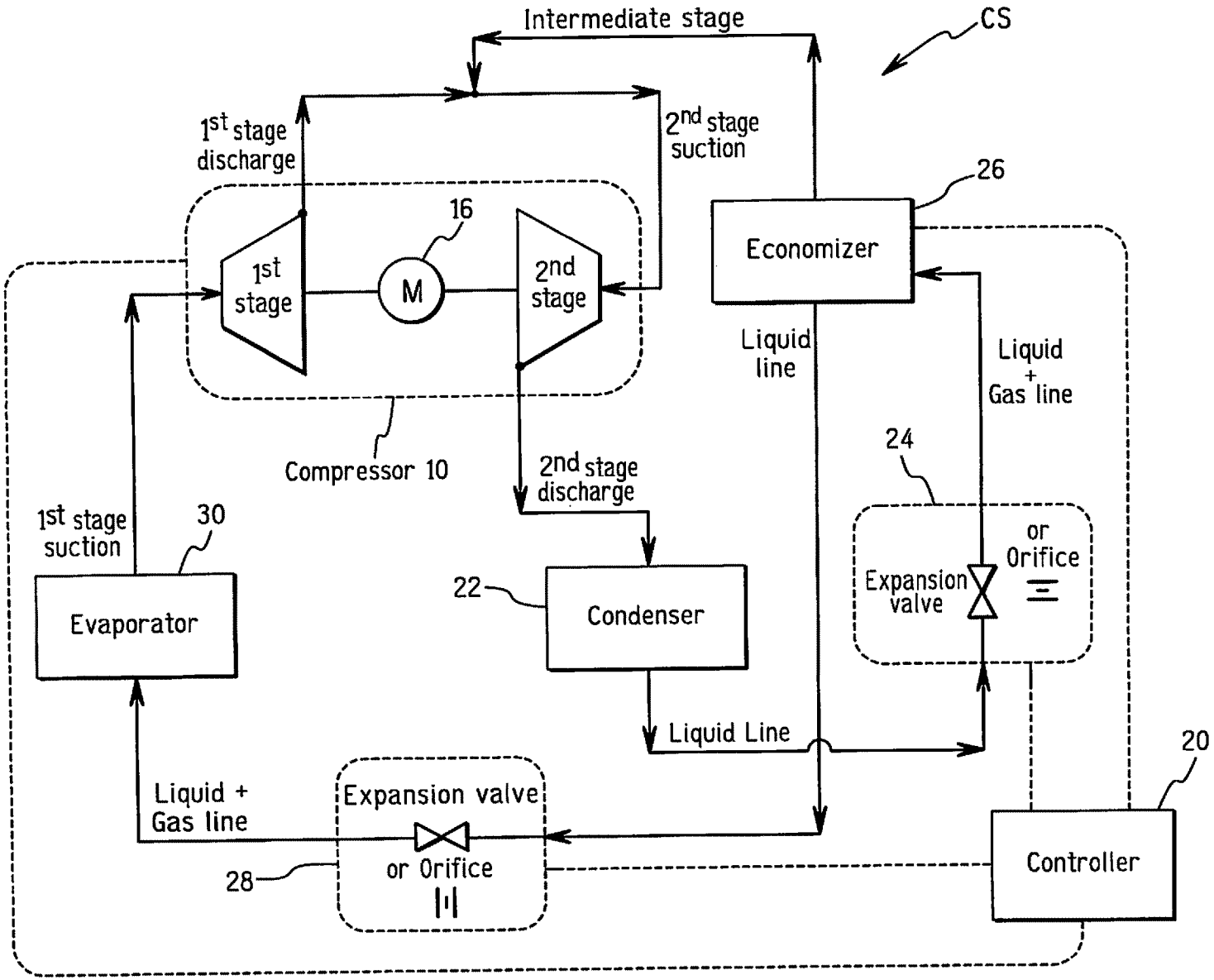
FIG. 1 is a schematic diagram illustrating a two stage chiller system (with an economizer) having a centrifugal compressor in accordance with an embodiment of the present invention.

A centrifugal compressor 10 in accordance with the present invention is configured for use with a low global warming potential (GWP) refrigerant in loop refrigeration cycle (refrigeration circuit) and is particularly configured for use in an HVAC application. In the illustrated embodiment, the centrifugal compressor 10 is used in a chiller system CS as shown in FIG. 1. The centrifugal compressor 10 of this embodiment is a two stage compressor, and thus, the chiller system CS shown in FIG. 1 is a two stage chiller system. The centrifugal compressor 10 includes a casing 12, a first impeller 14 (first impeller), and a motor 16. As will be explained in more detail later, the first stage impeller 14 is equipped with first blades 18 having a fully nonlinear shape in a quasi-orthogonal cross-sectional view.

Referring again to FIG. 1, the components of the chiller system CS will now be briefly explained. The chiller system CS basically includes a chiller controller 20, the centrifugal compressor 10, a condenser 22, an expansion valve or orifice 24, an economizer 26, an expansion valve or orifice 28, and an evaporator 30 connected together in series with piping to form a loop refrigeration circuit containing a low global warming potential (GWP) refrigerant. Various sensors (not shown) are disposed throughout the circuits of the chiller system CS to control the chiller system CS. The sensors and the use of information from the sensors to control the chiller system CS will not be explained and/or illustrated in detail herein. It will be apparent to those skilled in the art from this disclosure that an explanation of normal operation of the chiller system CS has been omitted for the sake of brevity, except as related the structure and operation of the centrifugal compressor 10. In addition, it will be apparent to those skilled in the art from this disclosure that the economizer 26 of the chiller system CS is optional.

The method of producing refrigeration of the illustrated chiller system CS includes compressing the low global warming potential ("low-GWP") refrigerant, e.g., R1233zd, R1234ze or R1234yf, in the compressor 10. The compressed refrigerant is then sent to the condenser 22 where heat is transferred from the refrigerant to a medium (water in this embodiment). The refrigerant cooled in the condenser 22 is then expanded by the expansion valve 28 and sent to the evaporator 30. In the evaporator 30, the refrigerant absorbs heat from the medium (water in this embodiment) to chill the medium. In this way, refrigeration is produced. The refrigerant is then sent back to the centrifugal compressor 10 and the cycle is repeated.

FIG. 1 merely illustrates one example of a chiller system CS in which a centrifugal compressor 10 in accordance with the present invention can be used. The centrifugal compressor 10 is a two stage compressor. However, the centrifugal compressor 10 may include three or more impellers (not shown) or may be a single stage compressor. Therefore, the two-stage centrifugal compressor 10 includes all the parts of a single stage compressor, but also includes additional parts. Accordingly, it will be apparent to those skilled in the art from this disclosure that the descriptions and illustrations of the two-stage centrifugal compressor 10 also apply to a single stage compressor, except for parts relating to the second stage of compression and modifications related to the second stage of compression (e.g., the housing shape, shaft end shape, etc.). In view of these points, and for the sake of brevity, only the two stage compressor 10 will be explained and/or illustrated in detail herein.

Figure 2:
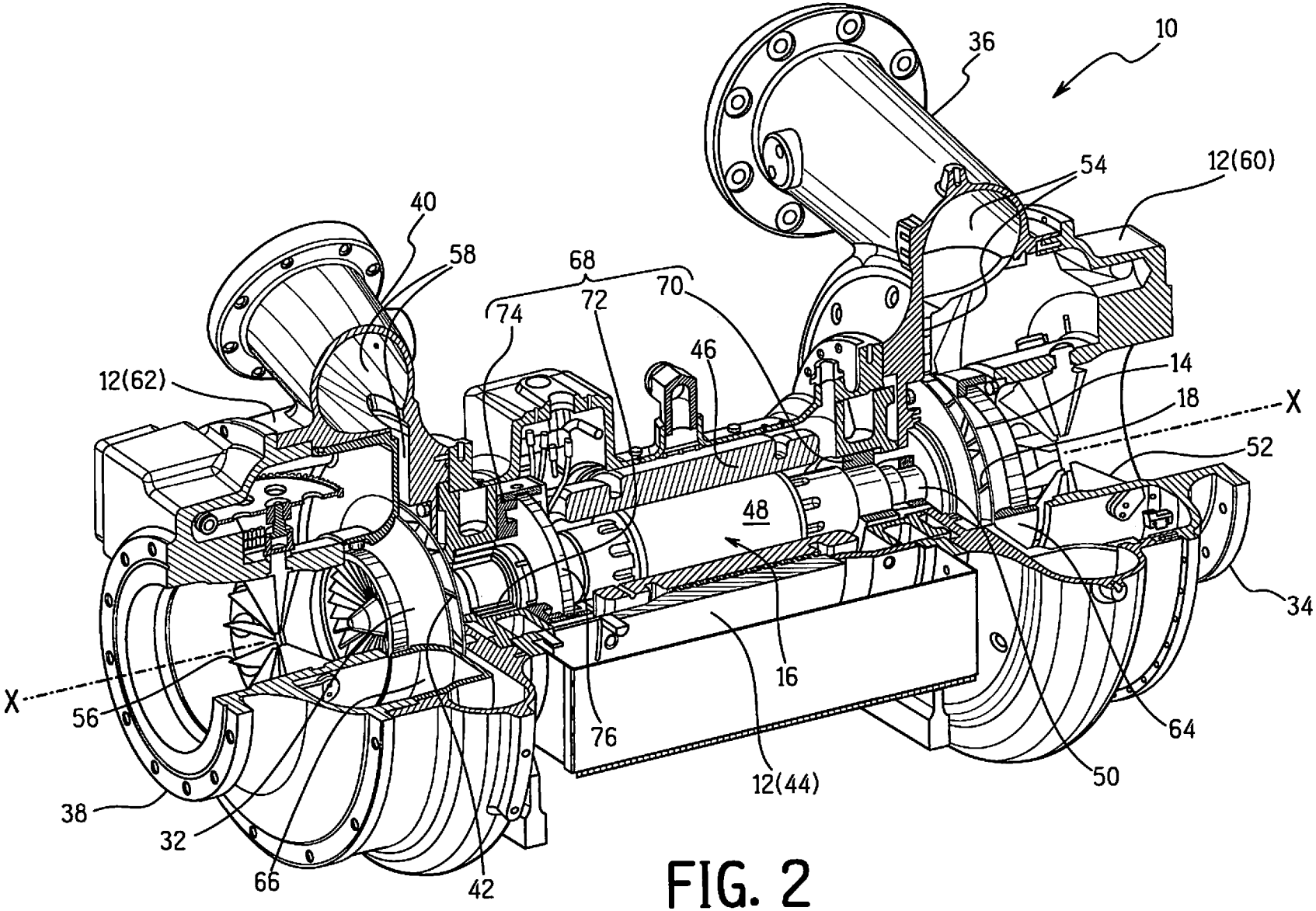
FIG. 2 is a perspective view of the centrifugal compressor of the chiller system illustrated in FIG. 1 in accordance with a first embodiment featuring a closed type fully nonlinear impeller, with portions of the centrifugal compressor broken away and shown in cross-section for the purpose of illustration.

Referring now to FIGS. 2-11, the centrifugal compressor 10 according to the illustrated embodiment will be described in more detail. In the embodiment, as mentioned above, the compressor 10 is a two-stage centrifugal compressor. The casing 12 of the centrifugal compressor 10 houses the first stage impeller 14 and the motor 16. The casing 12 also houses a second stage impeller 32 (second impeller). In the embodiment, the first and second stage impellers 14 and 32 are closed type impellers that include a shroud S, but it is also acceptable for the first and second stage impellers 14 and 32 to be open type impellers. As shown in FIG. 2, the motor 16 is disposed between the first stage impeller 14 and the second stage impeller 32. The casing 12 includes a first inlet portion 34 and a first outlet portion 36 that guide the low global warming potential (GWP) refrigerant toward and away from the first stage impeller 14. That is, the casing 30 is configured such that the low global warming potential (GWP) refrigerant enters the first impeller 14 from the first inlet portion 34 along an axial direction of the first stage impeller 14 and exits the first stage impeller 14 to the first outlet portion 36 in a radial direction of the first impeller 14. The first stage impeller 14 is disposed between the first inlet portion 34 and the first outlet portion 36.

Similarly, the casing 12 includes a second inlet portion 38 and a second outlet portion 40 that guide the refrigerant toward and away from the second stage impeller 32. That is, the casing 12 is configured such that the low global warming potential (GWP) refrigerant enters the second stage impeller 32 from the second inlet portion 38 along an axial direction of the second stage impeller 32 and exits the second stage impeller 32 to the second outlet portion 40 in a radial direction of the second stage impeller 32. The second stage impeller 32 is disposed between the second inlet portion 38 and the second outlet portion 40. The second stage impeller 32 is equipped with second blades 42 having a fully nonlinear shape in a quasi-orthogonal cross-sectional view.

In this embodiment, the two-stage centrifugal compressor is a so-called "back-to-back" type two-stage centrifugal compressor in which the first stage impeller and the second stage impeller are arranged with the hubs facing each other and the shrouds (inlet sides) facing outward. However, the present invention is not limited to a back-to-back arrangement of the two impellers. For example, the claimed invention is also applicable to a two-stage centrifugal compressor having an inline arrangement in which the impellers face in the same direction, i.e., with the shroud or inlet side of one impeller facing the back of the hub of the other impeller. Moreover, the claimed invention is applicable to a centrifugal compressor having three or more impellers arrange inline.

The casing 12 further includes a motor housing portion 44 that is disposed axially between the first stage impeller 14 and the second stage impeller 32 and configured to enclose the motor 16. In the illustrated embodiment, the motor housing portion 44 has a generally cylindrical shape and fixedly supports a stator 46 of the motor 38 on an inside of the motor housing portion 44. In addition to the stator 46, the motor 16 of the illustrated embodiment also includes a rotor 48 that is mounted on a middle portion of a rotary shaft 50. The first stage impeller 16 is attached to a first end of the rotary shaft 50, and the second impeller 32 is attached to a second end of the rotary shaft 50. The rotary shaft 50 is rotatable about a rotation axis X. The motor 16 is arranged inside the casing 12 to rotate the rotary shaft 50 in order to rotate the first stage impeller 14 and the second stage impeller 32.

In the illustrated embodiment, the centrifugal compressor 10 further includes a first stage inlet guide vane 52 disposed between the first inlet portion 34 and the first stage impeller 14, and a first diffuser/volute 54 disposed between the first stage impeller 14 and the first outlet portion 36. Similarly, the centrifugal compressor 10 includes a second stage inlet guide vane 56 disposed between the second inlet portion 38 and the second stage impeller 32, and a second diffuser/volute 58 disposed between the second stage impeller 32 and the second outlet portion 40. Although the first and second stages include inlet guide vanes 52 and 56 in the illustrated embodiment, the inlet guide vanes are optional and the claimed invention is not limited to a centrifugal compressor equipped with inlet guide vanes.

Additionally, although centrifugal compressor 10 of the illustrated embodiment has a single motor 16 and a single rotary shaft 50 with both the first stage impeller 14 and the second stage impeller 32 attached to the rotary shaft 50, the present invention is also applicable to a centrifugal compressor provided with a separate motor and shaft for each of the first and second stage sides of the centrifugal compressor. Also, as mentioned previously, the present invention is also applicable to a single stage compressor.

As shown in FIG. 2, the casing 12 further includes a first end portion 60 that joins a first end of the motor housing portion 44 and surrounds the first stage impeller 14. The casing 12 also includes a second end portion 62 that joins a second end of the motor housing portion 44 and surrounds the second stage impeller 32. The first end portion 60 includes a first shroud cover portion 64 that is arranged closely adjacent the first stage impeller 14 on an inlet side (axially outward side) of the first stage impeller 14. In the illustrated embodiment, the first shroud cover portion 64 has a curved shape that generally corresponds to a contour of the inlet side of the first stage impeller 14. Likewise, the second end portion 62 includes a second shroud cover portion 66 that is arranged closely adjacent the second stage impeller 32 on an inlet side (axially outward side) of the second stage impeller 32. In the illustrated embodiment, the second shroud cover portion 66 has a curved shape that generally corresponds to a contour of the inlet side of the second stage impeller 32.

The rotary shaft 50 of the centrifugal compressor 10 of the illustrated embodiment is supported on a magnetic bearing assembly 68 that is fixedly supported to the casing 12. The magnetic bearing assembly 68 includes a first radial magnetic bearing 70, a second radial magnetic bearing 72, and an axial magnetic bearing 74. The axial magnetic bearing 74 supports the rotary shaft 50 along the rotational axis X by acting on a thrust disk 76. The axial magnetic bearing 74 includes the thrust disk 76 which is attached to the rotary shaft 50. The thrust disk 76 extends radially from the rotary shaft 50 in a direction perpendicular to the rotational axis X, and is fixed relative to the rotary shaft 50. A magnetic bearing is a bearing that uses magnetic force to levitate a rotary shaft such that the rotary shaft can rotate with very low friction. While magnetic bearings are described herein, it will be apparent to those skilled in the art from this disclosure that other types and forms of bearings maybe used in the centrifugal compressor 10 according to this invention.

The shape of the first stage impeller 14 will now be explained with reference to FIGS. 3-11. In this embodiment, the second stage impeller 32 has a similar shape. Thus, a detailed description of the second stage impeller 32 is omitted for the sake of brevity.

As mentioned previously, the first stage impeller 14 of the centrifugal compressor 10 is equipped with first blades 18 having a fully nonlinear shape in a quasi-orthogonal cross-sectional view. A quasi-orthogonal cross-sectional view is a view lying in a cross section across a meridional plane of the first stage impeller 14. A meridional plane is a plane defined by a constant polar angle in a cylindrical coordinate system arranged such that the Z-axis of the cylindrical coordinate system coincides with the rotation axis X of the first stage impeller 14. Since the first blades 18 are not flat, a meridional view of one of the first blades 18 is defined to be a projection of the first blade 18 onto the meridional plane. A quasi-orthogonal cross section is a section lying in a plane that is perpendicular to the meridional plane and passes through the first blade 18. For example, see cross sections A-A and B-B in FIG. 4.

Figure 3:
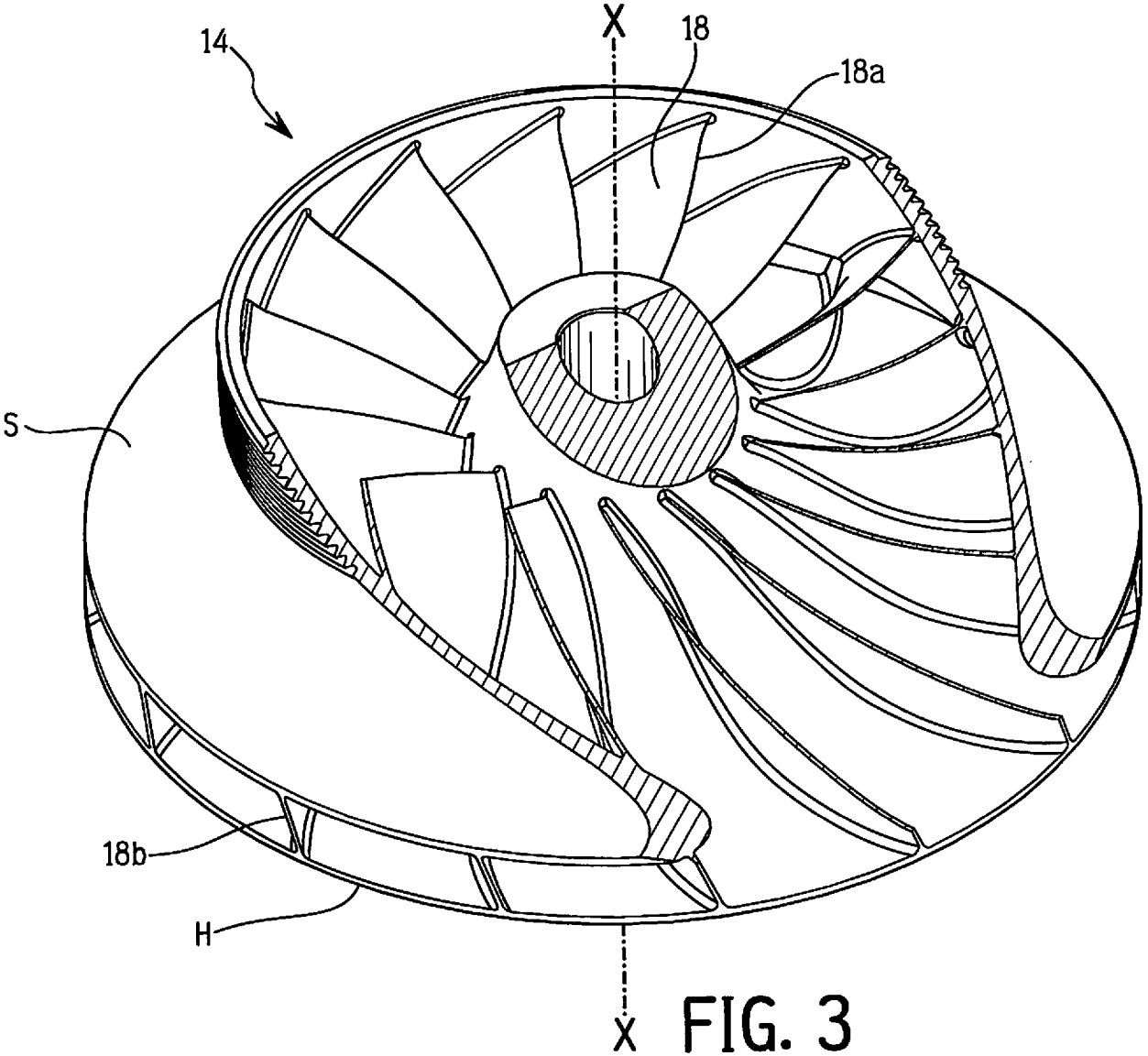
FIG. 3 is a perspective view of the fully nonlinear impeller according to the embodiment with a portion cut away and shown in cross section.
Figure 4:
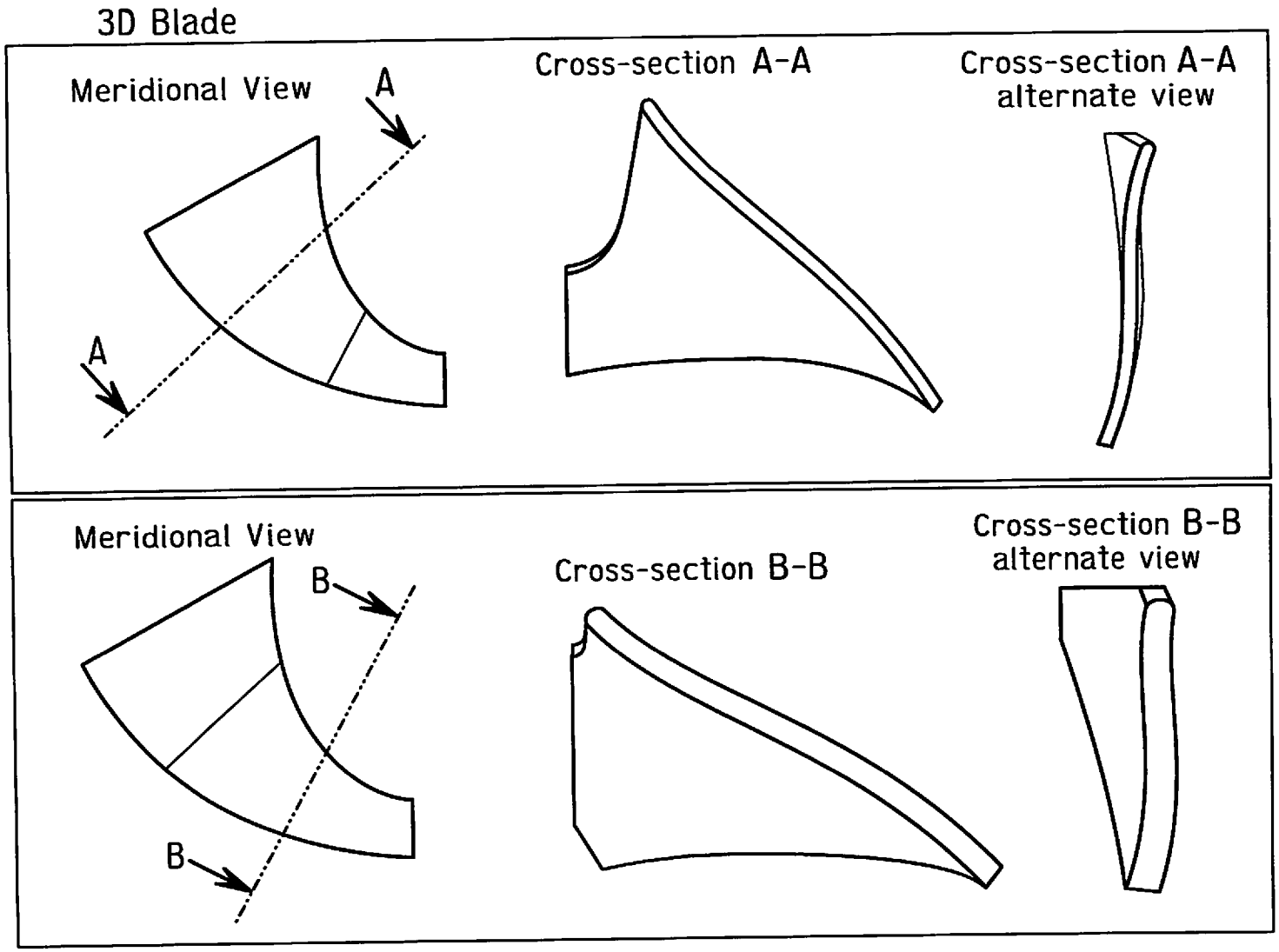
FIG. 4 illustrates two quasi-orthogonal cross sections of a blade of the fully nonlinear impeller.
Figure 6A:
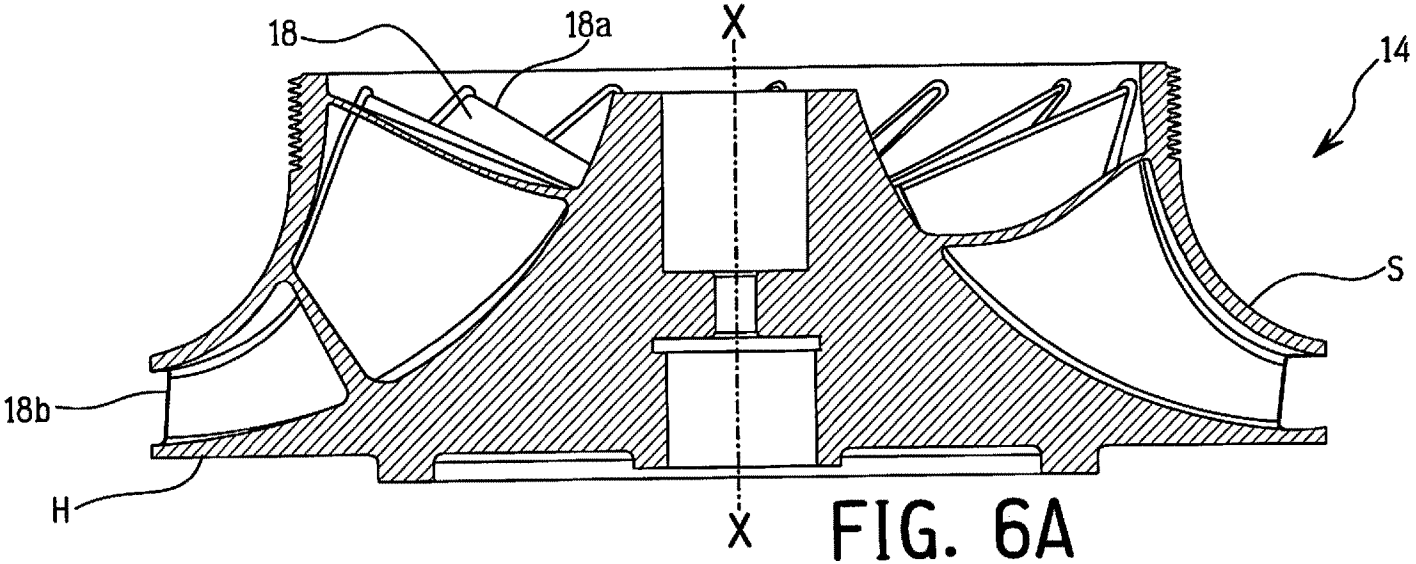
FIGS. 6A and 6B show cross sectional views of the fully nonlinear impeller according to the embodiment and the conventional 2D impeller, respectively, which include a rotational axis of the impeller.

In this embodiment, as shown in FIGS. 3 and 6A, the first stage impeller 14 is a closed type impeller including a hub portion H and a shroud portion S. The first blades 18 are disposed between the hub portion H and the shroud portion S. In the first stage impeller 14, the quasi-orthogonal view is defined by connecting similar points across a normalized length of the curves of the hub portion H and the shroud portion S. As shown in FIG. 4, the quasi-orthogonal cross-sectional shape of the first stage blades 14 are fully nonlinear in each of the quasi-orthogonal cross sections A-A and B-B. In this embodiment, all quasi-orthogonal cross sections of the first stage blades 14 have a nonlinear shape. Moreover, in this embodiment, the curvature of the nonlinear shape in the quasi-orthogonal cross-sectional-view varies along a length of the quasi-orthogonal cross-sectional view from the hub portion to the shroud portion. Depending the particular design parameters, the cross sectional shape of the quasi-orthogonal cross sections may be generally C-shaped or may be S-shaped with an inflection point where the curvature changes direction. The fully nonlinear first stage blades 14 are nonlinear in the quasi-orthogonal cross sections because their shapes are not defined by such surfaces as planes, cylindrical surfaces, and conical surfaces, and their shapes vary more freely in response to the particular design requirements.

Figure 7B:
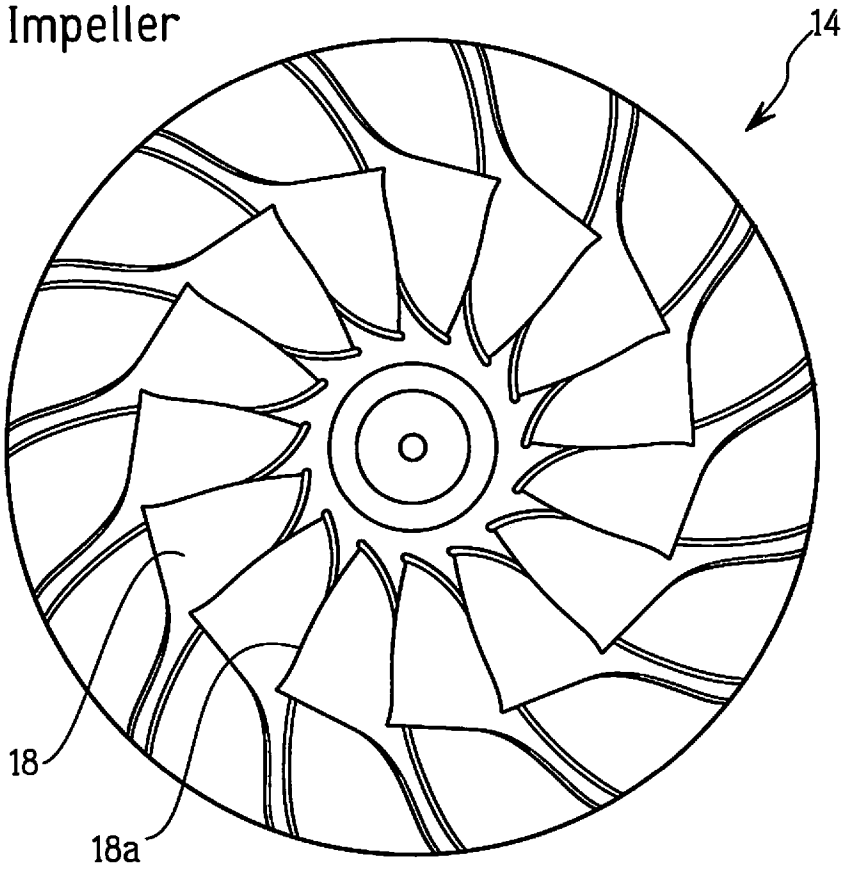
FIG. 7B shows a side view of the same with the shroud removed.
Figure 7A:
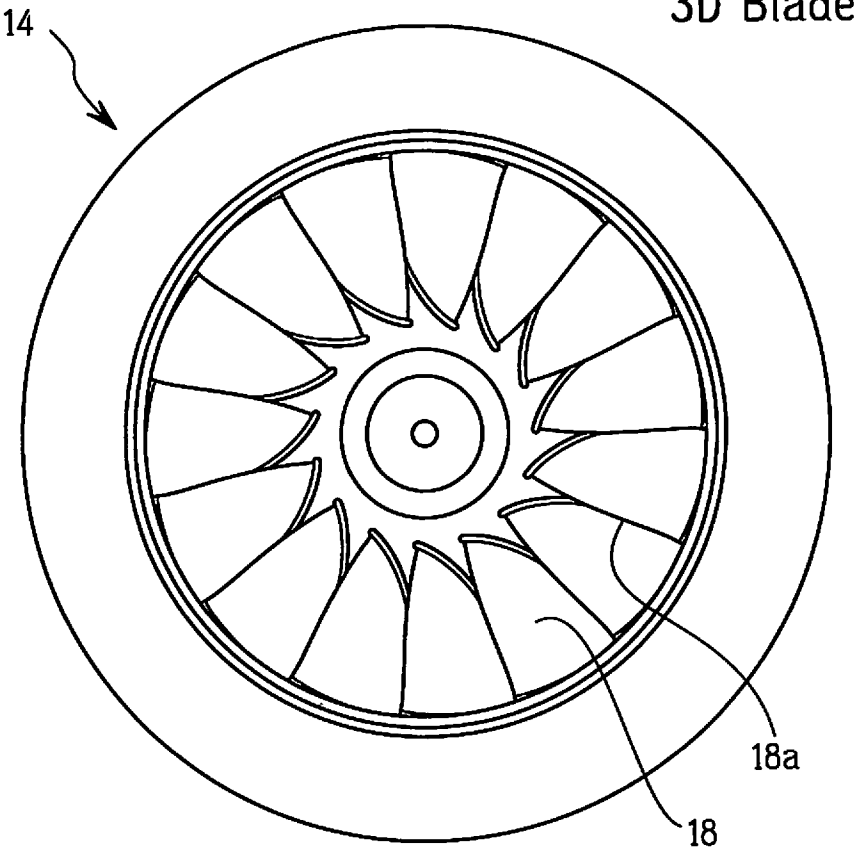
FIG. 7A shows a side view of the fully nonlinear impeller as viewed along a direction parallel to a rotational axis of the fully nonlinear impeller.

The cross sectional shape of the first blades 18 is also nonlinear in a cross sectional view of the first stage impeller 14 lying in a section plane that includes the rotation axis X, as shown in FIG. 6A. Additionally, as shown in FIGS. 7A and 7B, a leading edge 18*a* of each of the first blades 18 has a nonlinear shape when an inlet side of the first stage impeller 14 (i.e., the side arranged facing the first stage inlet guide vane 52) is viewed along a direction parallel to the rotation axis X.

Figure 10:
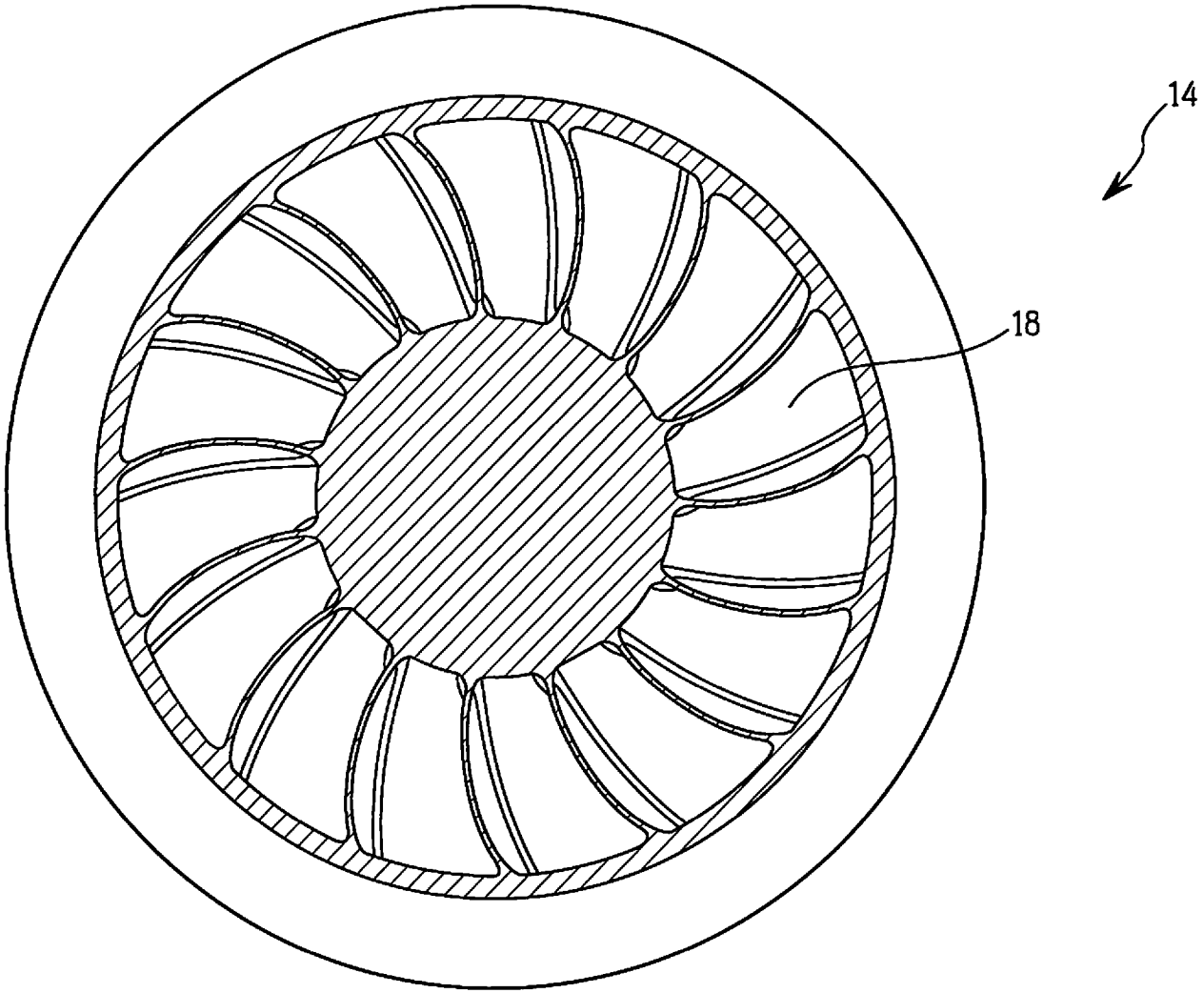
FIG. 10 is a cross sectional view of the fully nonlinear impeller lying in a section plane that is perpendicular to the rotation axis.

As shown in FIG. 10, in this embodiment, the first blades 14 have a nonlinear shape in a cross sectional view lying in a plane that is perpendicular to the rotation axis. Moreover, in this embodiment, the first blades 14 have a nonlinear shape in all cross sectional views lying in a plane that is perpendicular to the rotation axis along an axial length of the first blades, and the first blades 14 have a nonlinear shape in all the quasi-orthogonal cross-sectional views across the meridional plane. Furthermore, in this embodiment, as shown in FIGS. 11A and 11B, the first blades 18 have a nonlinear cross sectional shape in cross sections taken longitudinally through the first blades 18 in the meridional plane.

Figure 5:
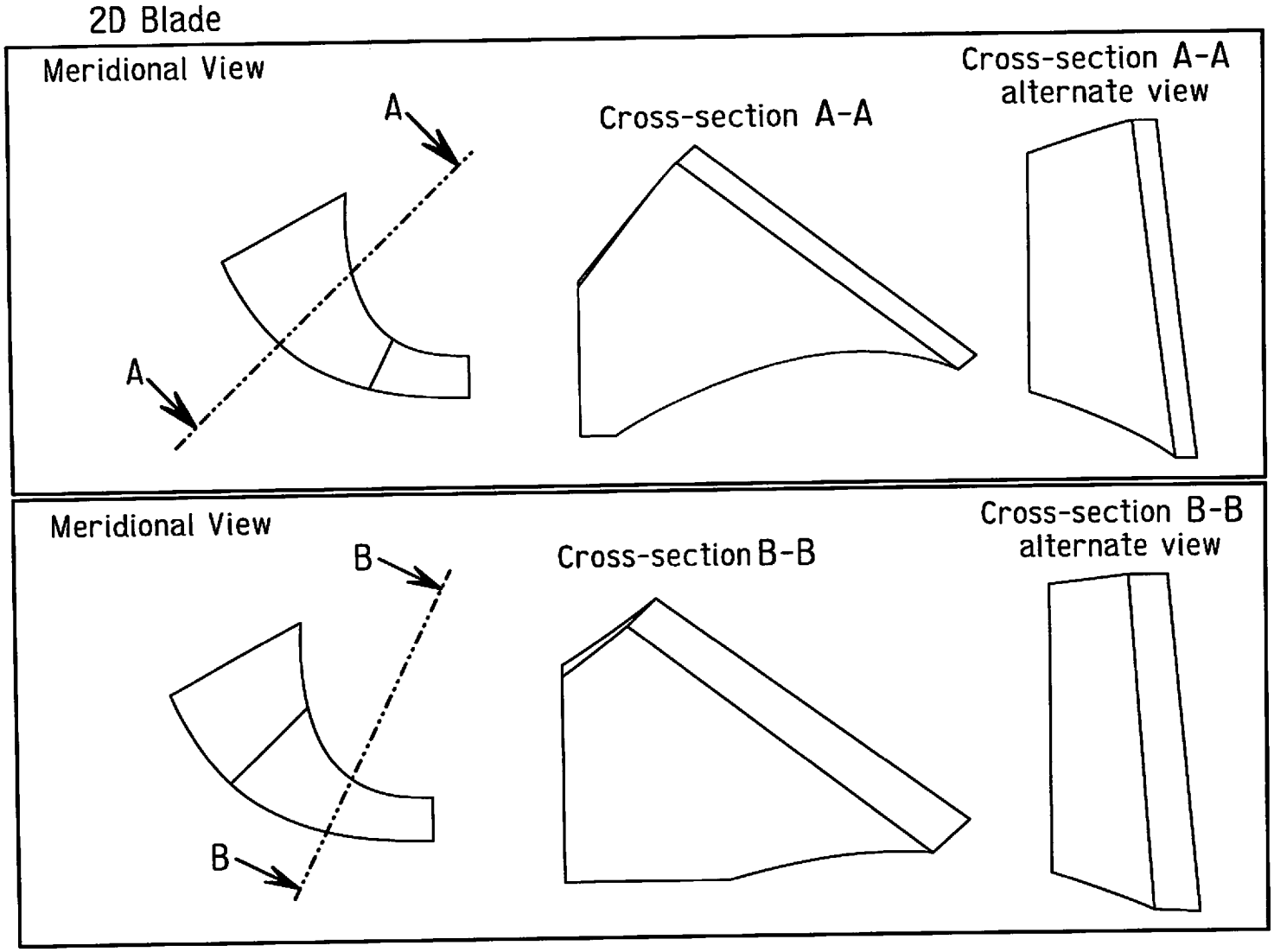
FIG. 5 (Prior Art)
FIG. 5 illustrates two quasi-orthogonal cross sections of a conventional 2D blade of an impeller for a centrifugal compressor.
Figure 6B:
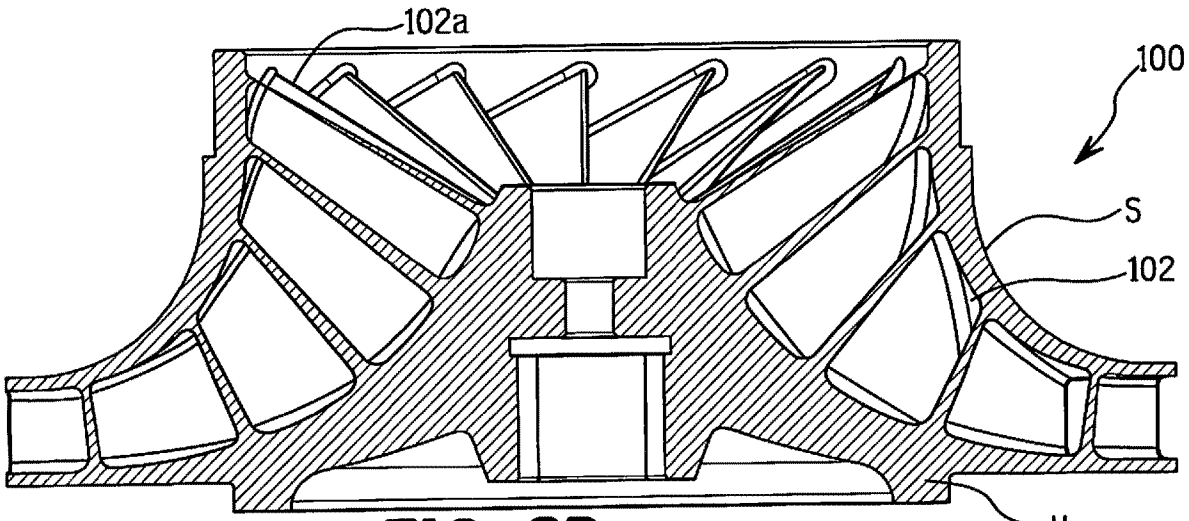
FIG. 6B (Prior Art)
Figure 8B:
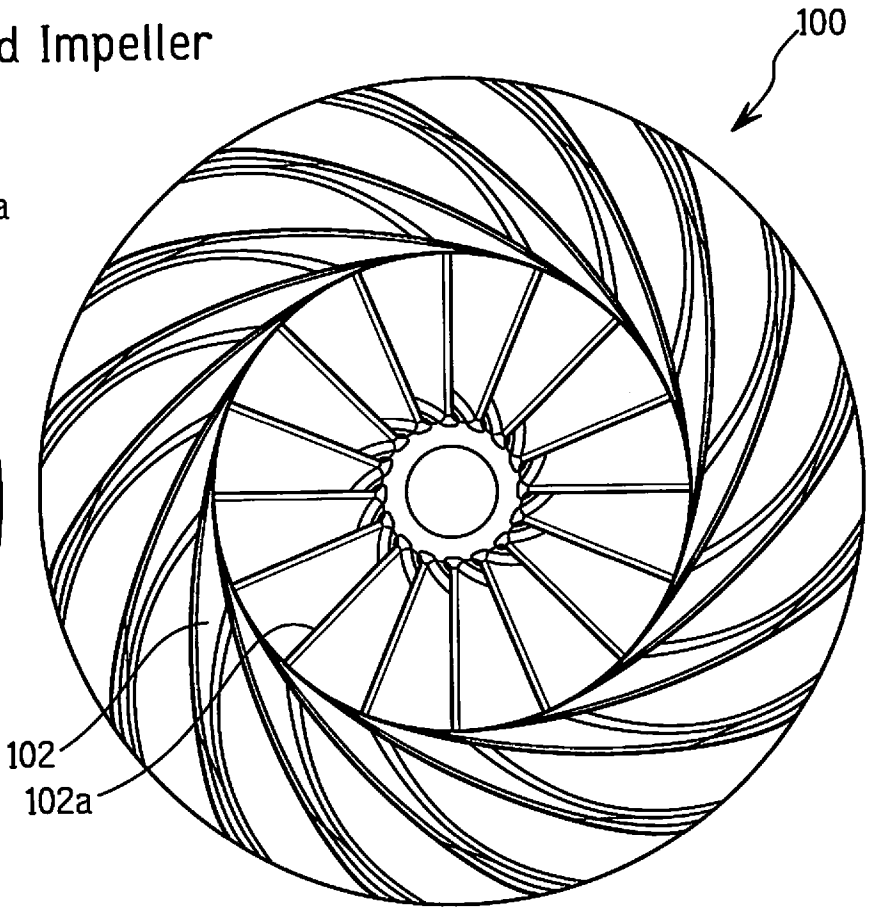
FIG. 8B (Prior Art)
FIG. 8B shows a side view of the same with the shroud removed.
Figure 8A:
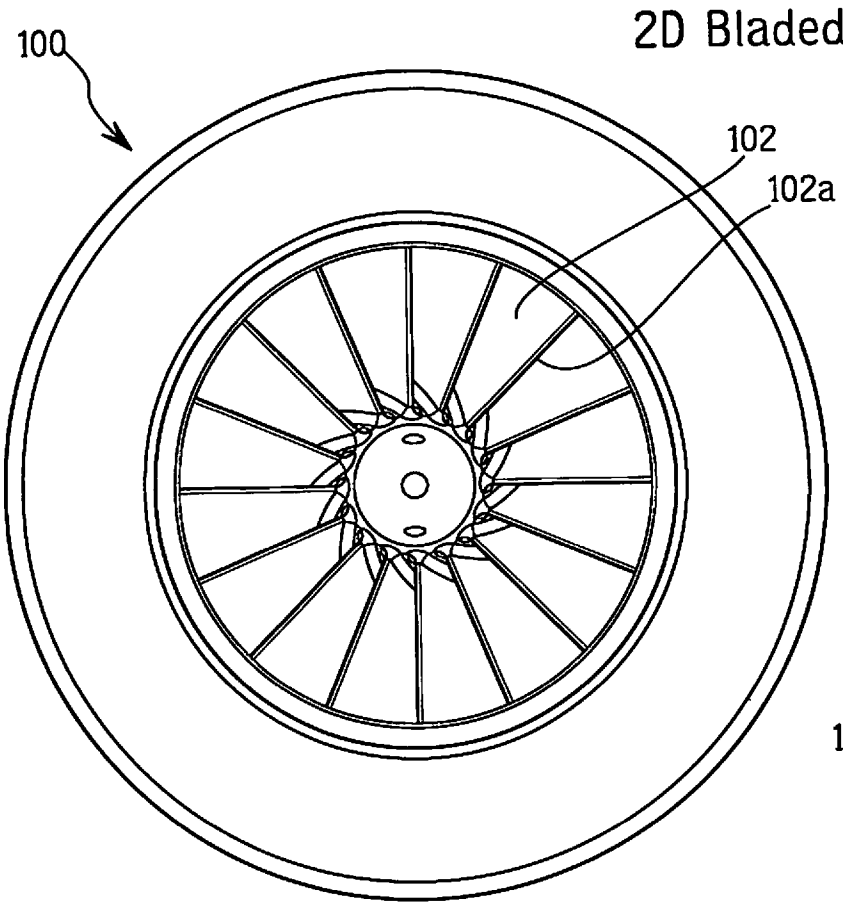
FIG. 8A (Prior Art)
FIG. 8A shows a side view of the conventional 2D impeller as viewed along a direction parallel to a rotational axis of the conventional 2D impeller.

By contrast, in a conventional 2D impeller 100, all quasi-orthogonal cross sections of a blade 102 of the conventional 2D impeller 100 have a completely linear shape, as illustrated by the quasi-orthogonal cross sections C-C and D-D shown in FIG. 5. The cross sectional shapes of the 2D blades 102 are also linear in a cross sectional view of the 2D impeller 100 lying in a section plane that includes the rotation axis, as shown in FIG. 6B. The 2D blades may have a tapered shape due to variation of the thickness of the blade between the hub and the shroud, but the cross sectional shape is linear in these cross sections of the 2D blades. Additionally, as shown in FIGS. 8A and 8B, the leading edge 102*a* of the blades 102 of the 2D impeller 100 is linear in a side view of the inlet side of the 2D impeller as viewed along a direction parallel to the rotation axis. The linearity of the 2D blade 102 exists because the 2D blade 102 is a ruled blade in which the shape of the blade 102 is defined by such specifically shaped surfaces as planes, cylindrical surfaces, and conical surfaces.

In this embodiment, the first stage impeller 14 is made by casting. Due to the complex shape of a fully nonlinear blade, it can be challenging to fabricate a fully nonlinear blade using conventional cutting and machining techniques. In this embodiment, the first blades 18 of the first stage impeller 14 are made by casting in order to accurately reproduce the fully nonlinear design of the first blade 18. However, the first stage impeller is not limited to being made by casting. Other manufacturing methods can be used. For example, three-dimensional printing may be used.

It has been found that desirable results are obtained with low-GWP refrigerants when a hub-side blade angle delta of each of the first blades 18 and/or the second blades 42 is largest (i.e., has a peak) at a position closer to the leading edge than to the trailing edge of the blade in the streamwise direction, i.e, the blade length direction from the inlet of the impeller to the outlet of the impeller. More specifically, the blade angle of the 3D impeller blade varies with respect to both the position in the streamwise direction and the position across the span from hub to shroud. In this application, a "blade angle delta" is defined to be a difference between a maximum blade angle and a minimum blade angle in a prescribed range of positions in the span direction. Thus, for example, a blade angle delta for the range of positions from hub to mid-span can be determined for any given position in the streamwise direction, and a blade angle delta for the range of positions from mid-span to shroud can be determined for any given position in the streamwise direction. In this application, the former is called "hub-side blade angle delta" and the latter is called "shroud-side blade angle delta."

Figure 14:
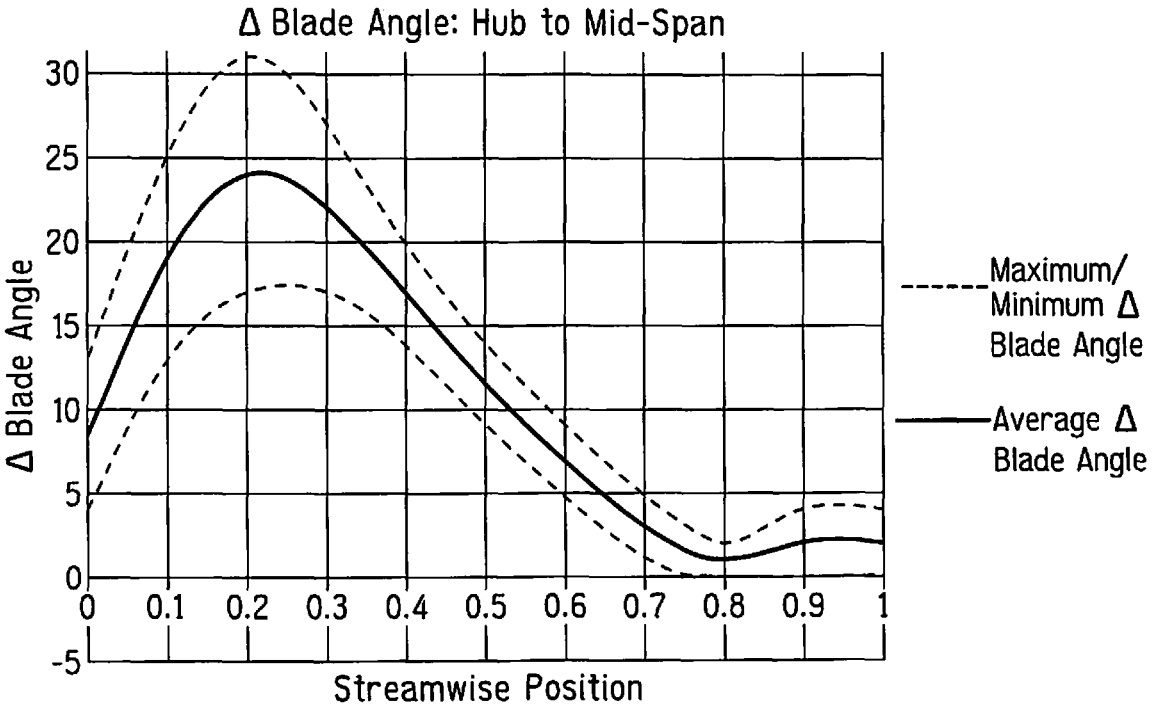
FIG. 14 illustrates how the blade angle delta varies from the leading edge to the trailing edge in the region from the hub to mid-span.

Thus, it has been found that the first blades 18 and/or the second blades 42 are preferably configured such that the hub-side blade angle delta of each of the blades is largest (i.e., has a peak) at a position closer to the leading edge, and more preferably at a position in a range of 10 to 40% of the blade length in the streamwise direction, where 0% corresponds to the leading edge of the impeller blade and 100% corresponds to the trailing edge of the impeller blade. Moreover, it is been found that superior performance is obtained when the hub-side blade angle delta is in the range 10 to 30 degrees at the position were the hub-side blade angle delta is largest. See FIG. 14.

Figure 15:
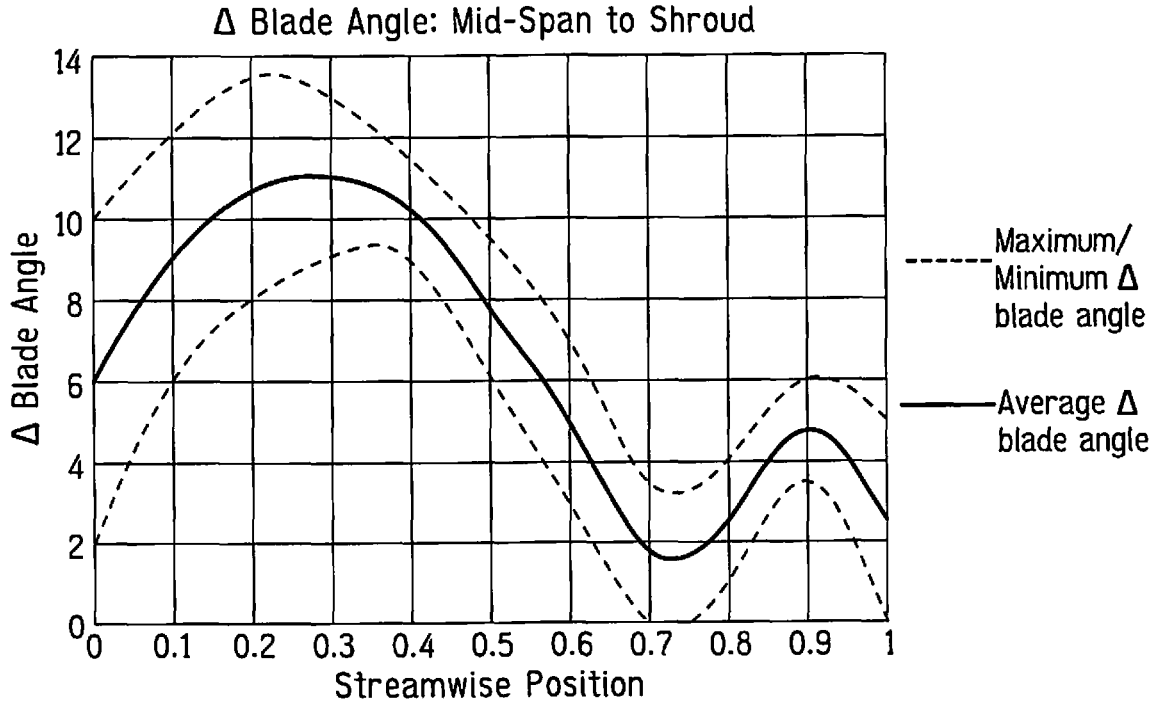
FIG. 15 illustrates how the blade angle delta varies from the leading edge to the trailing edge in the region from mid-span to the shroud.

Similarly, it has been found that the first blades 18 and/or the second blades 42 are preferably configured such that the shroud-side blade angle delta of each of the blades is largest (i.e., has a peak) at a position closer to the leading edge, and more preferably at a position in a range of 10 to 40% of the blade length in the streamwise direction, where 0% corresponds to the leading edge of the impeller blade and 100% corresponds to the trailing edge of the impeller blade. Moreover, it has been found that the superior performance is obtained when the shroud-side blade angle delta is in the range 6 to 14 degrees at the position were the shroud-side blade angle delta is largest. Moreover, the shroud-side blade angle delta preferably has a second peak value at a position closer to the trailing edge than the leading edge, and more preferably at a position in the range of 70 to 100% of the blade length in the streamwise direction. Moreover, it is been found that superior performance is obtained when the shroud-side blade angle delta is in the range 2 to 8 degrees at the position of the second peak of the shroud-side blade angle delta. See FIG. 15.

Figure 12:
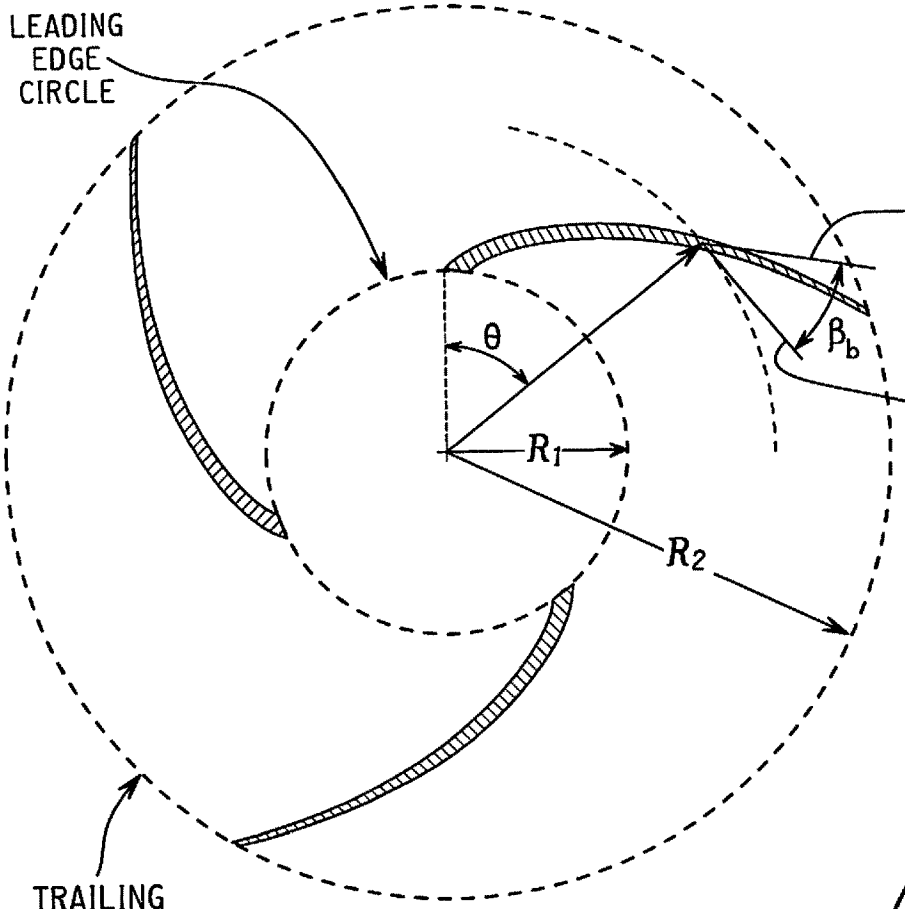
FIG. 12 illustrates the concept of the blade angle.

The blade angle will now be discussed with reference to FIG. 12. FIG. 12 is a cross section in a plane perpendicular to the axis of rotation of the impeller. The blade angle can be defined by the equation $\tan \beta = r\, d\theta/dm$, where $\beta$ is the blade angle, r is the radius of the particular position along the blade in polar coordinates, $\theta$ is the tangential coordinate of the camber line, and m is the meridional distance. The blade angle $\beta$ is the inclination of the tangent to the chord of the blade in the meridional plane and the plane perpendicular to the axis of rotation. In FIG. 12, the blade angle $\beta$ can be seen as the angle between a straight line tangent to the chord and a straight line corresponding to the projection of the meridional plane. In the 3D blade, as explained above, the blade angle $\beta$ varies with respect to both the position in the streamwise direction and the position across the span from hub to shroud.

Figure 9C:
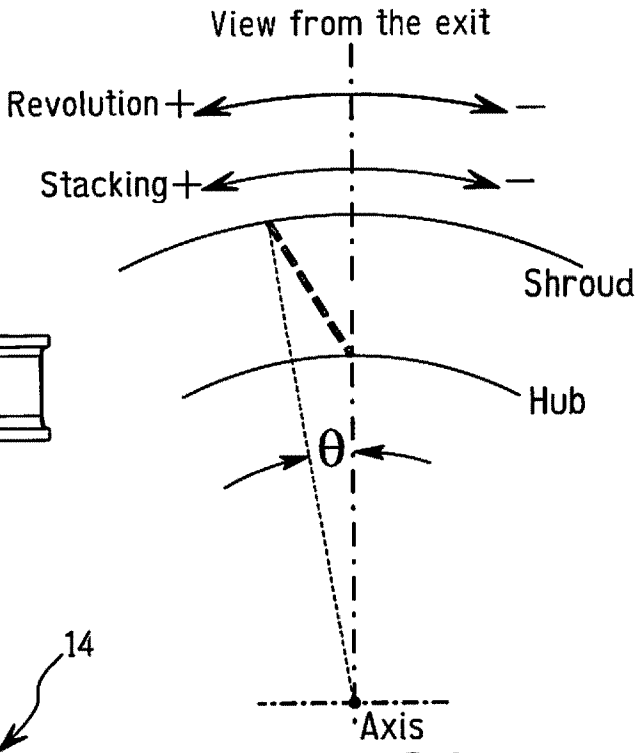
FIGS. 9A-9C illustrate a positive rake angle of the fully nonlinear impeller, with FIG. 9A being a view along a direction perpendicular to the rotation axis of an impeller having a rake angle of zero, FIG. 9B being a view along a direction perpendicular to the rotation axis of the fully nonlinear impeller illustrating a positive rake angle, and 9C being an explanatory diagram illustrating a positive rake angle.
Figure 9A:
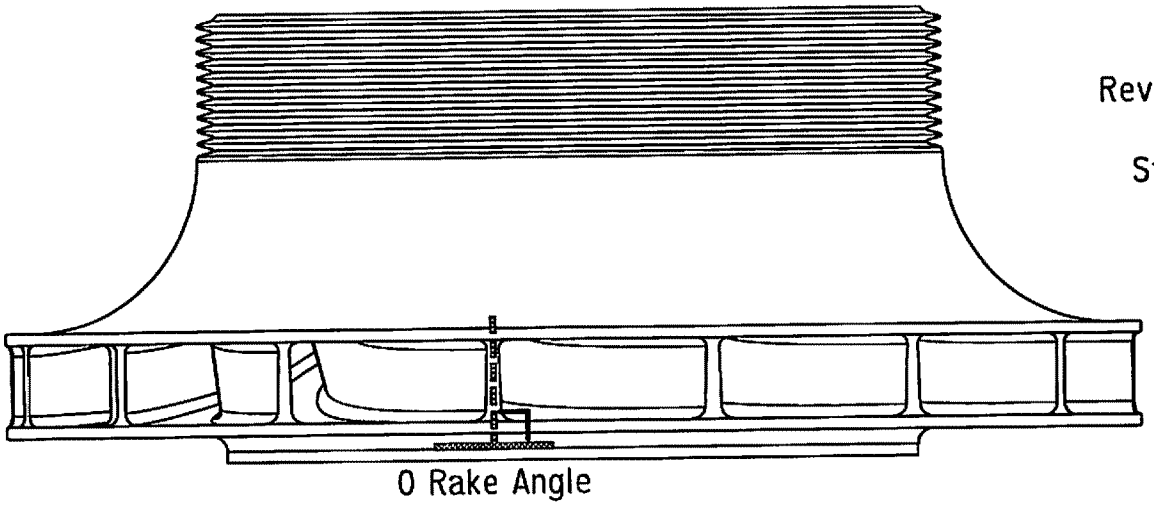
FIG. 9A (Prior Art)
Figure 9B:
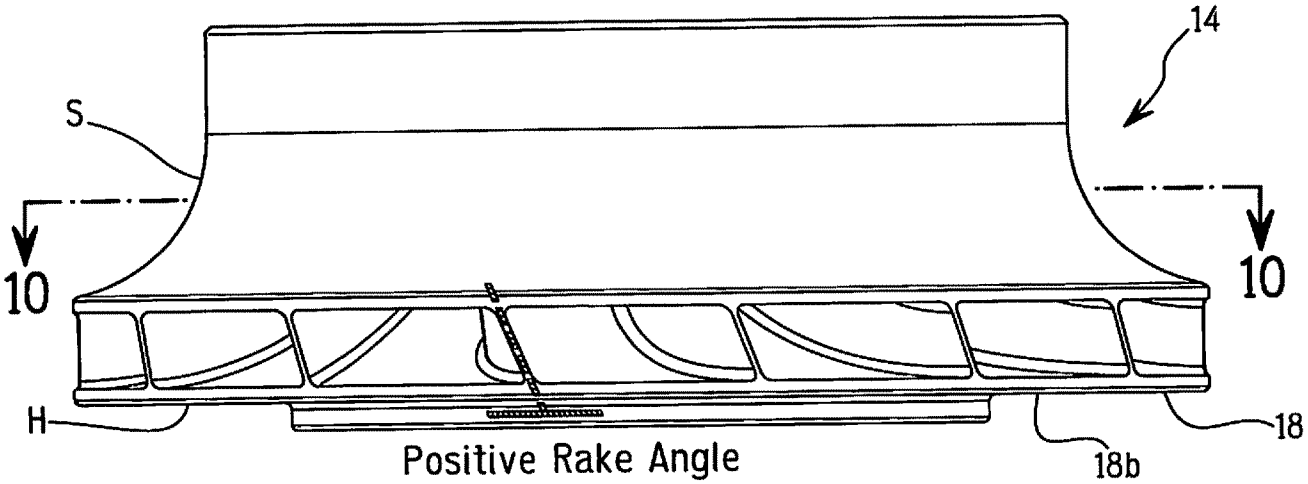
Figure 13:
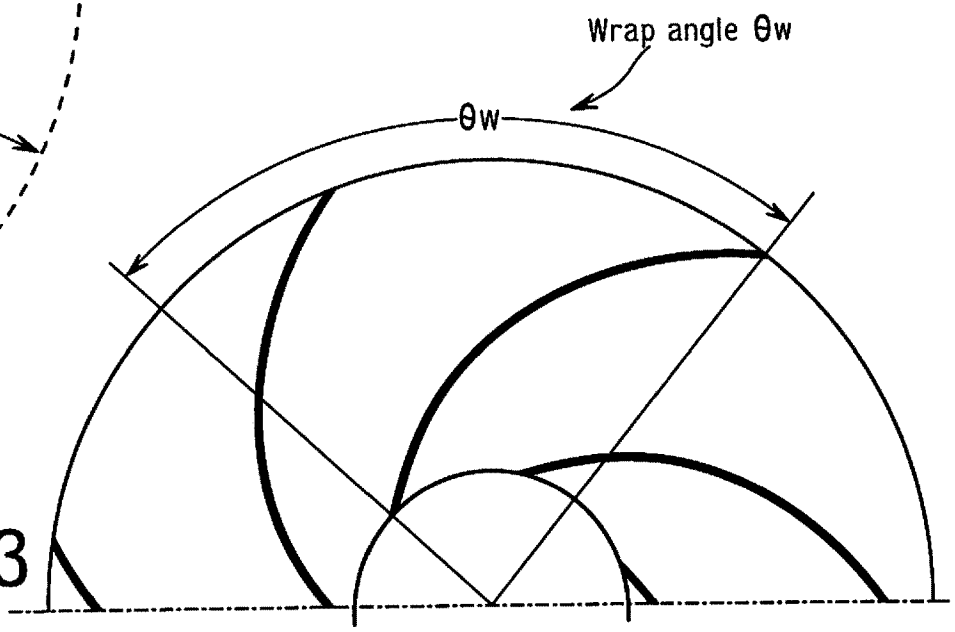
FIG. 13 illustrates the concept of the wrap angle.
Figure 16:
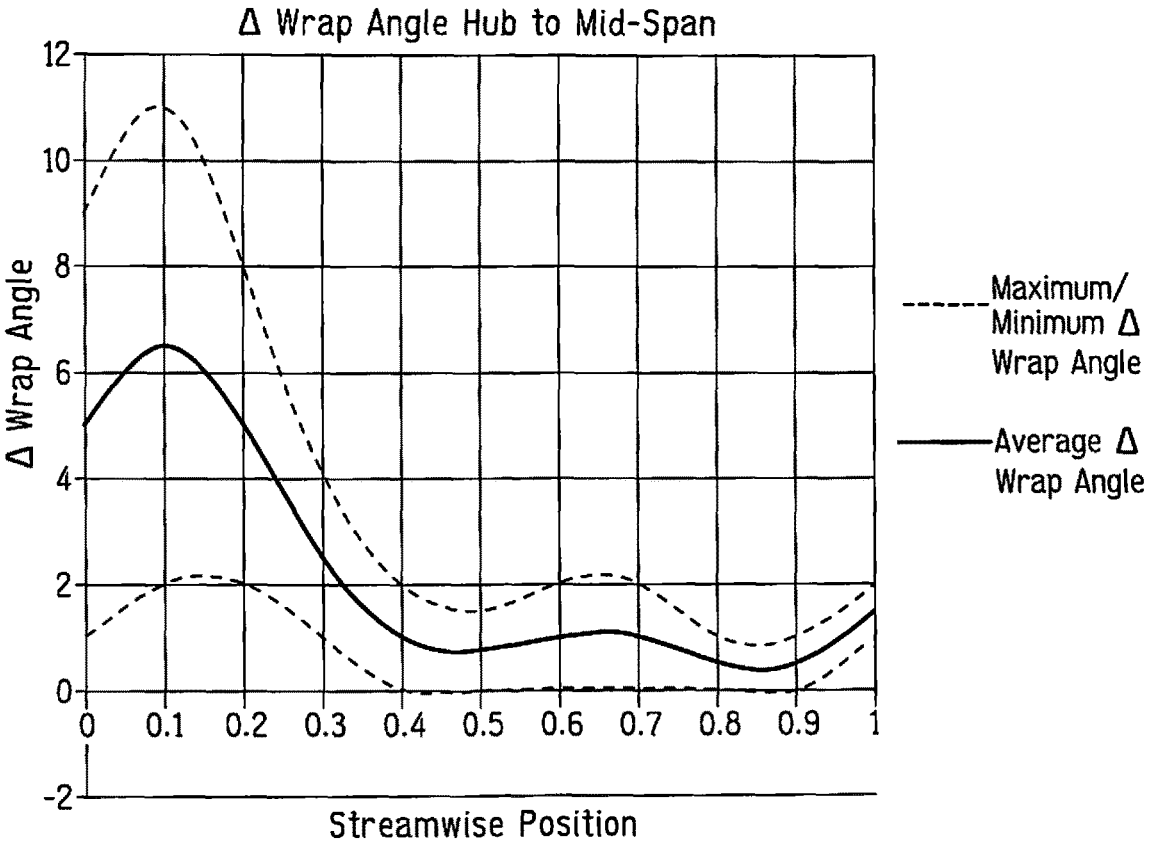
FIG. 16 illustrates how the wrap angle delta varies from the leading edge to the trailing edge in the region from the hub to mid-span.
Figure 17:
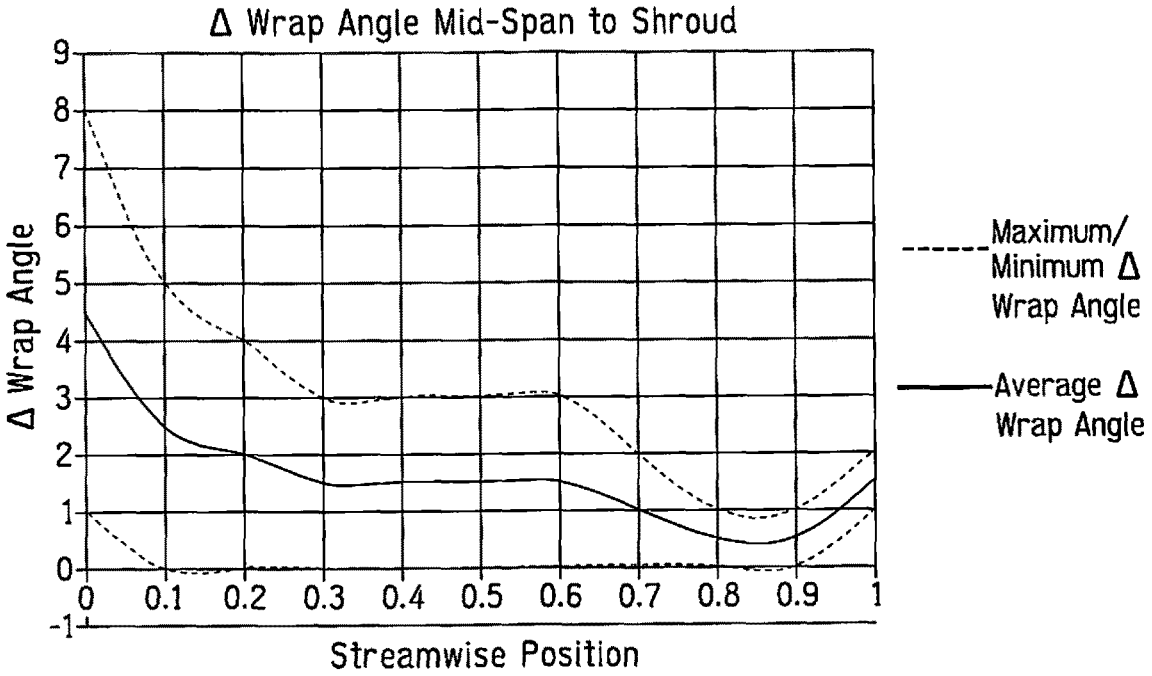
FIG. 17 illustrates how the wrap angle delta varies from the leading edge to the trailing edge in the region from the mid-span to the shroud.

It has also been found that the hub-side wrap angle delta of each of the blades is preferably largest (i.e., has a peak)

at a position closer to the leading edge than to the trailing edge. See FIG. 16. More preferably, the peak hub-side wrap angle delta is positioned between 0 and 40% of the blade length in the streamwise direction. Additionally, the hub-side wrap angle delta is preferably between 2 and 11 degrees at the position where the hub-side wrap angle delta is largest. Here, the wrap angle is the angular spread of blade from between the hub and the shroud when viewed along the axial direction of the 3D impeller. See the angle θw in FIG. 13. In this embodiment, a trailing edge 18*b* of each of the first blades 18 has a positive rake angle θ. As shown in FIGS. 9A-9C, a positive rake angle means the trailing edge 18*b* of the first blades 18 are slanted in the rotation direction of the first stage impeller 14 from the hub portion H to the shroud portion S. That is, as shown in FIG. 9C, a positive rake angle exists when the portion where the trailing edge 18*b* joins the shroud S is offset in the rotation direction of the first stage impeller 14 with respect to the portion where the trailing edge 18*b* joins the hub H such that a radial line from the rotation axis X to the portion where the trailing edge 18*b* joins the shroud S forms a rake angle θ with respect to a radial line from the rotation axis X to the portion where the trailing edge 18*b* joins the hub H. This offset is also called "stacking." It has been found that a positive rake angle is advantageous from the standpoint of suppressing secondary flows and achieving a more uniform flow leaving the impeller. Thus, by combining a positive rake angle with a fully nonlinear blade shape, the first stage impeller 14 of this embodiment can achieve high level of performance, e.g., a wide operating range and a high efficiency, when used with a low global warming potential (GWP) refrigerant in an HVAC application.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts.

The term "configured" as used herein to describe a component, section or part of a device includes hardware and/or software that is constructed and/or programmed to carry out the desired function.

The terms of degree such as "substantially", "about" and "approximately" as used herein mean a reasonable amount of deviation of the modified term such that the end result is not significantly changed.

While only a selected embodiment has been chosen to illustrate the present invention, it will be apparent to those skilled in the art from this disclosure that various changes and modifications can be made herein without departing from the scope of the invention as defined in the appended claims. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

As used herein, such directional terms as "vertical," "up", "down", "upper," "lower," "higher," "lower," "above," "below", "upward", "downward", "top", and "bottom", "side view," and "plan view," as well as any other similar directional terms, refer to those directions of the components and or the system as a whole in an installed state. Accordingly, these directional terms, as utilized to describe the centrifugal compressor, the impeller, and the refrigeration circuit for a chiller system should be interpreted relative to a chiller system in typically installed state.

Additionally, the term "low global warming potential (GWP) refrigerant" used herein refers to any refrigerant or blend of refrigerants that is suitable for use in the refrigeration circuit of a chiller system and has a low potential for contributing to global warming as benchmarked against $CO_2$ gas. The refrigerants R1233zd, R1234ze, and R1234fy are cited in this application as examples of low-GWP refrigerants. However, a person of ordinary skill in the refrigeration field will recognize that the present invention is not limited to these refrigerants.

Also it will be understood that although the terms "first" and "second" may be used herein to describe various components these components should not be limited by these terms. These terms are only used to distinguish one component from another. Thus, for example, a first component discussed above could be termed a second component and vice versa without departing from the teachings of the present invention. The term "attached" or "attaching", as used herein, encompasses configurations in which an element is directly secured to another element by affixing the element directly to the other element; configurations in which the element is indirectly secured to the other element by affixing the element to the intermediate member(s) which in turn are affixed to the other element; and configurations in which one element is integral with another element, i.e. one element is essentially part of the other element. This definition also applies to words of similar meaning, for example, "joined", "connected", "coupled", "mounted", "bonded", "fixed" and their derivatives.

What is claimed is:

1. A centrifugal compressor for use with a low global warming potential (GWP) refrigerant, the centrifugal compressor comprising:

a casing having a first inlet portion and a first outlet portion;

a first impeller disposed between the first inlet portion and the first outlet portion, the first impeller being attached to a first end of a shaft that is rotatable about a rotation axis, the first impeller being equipped with first blades, each of the first blades having a fully nonlinear shape in a quasi-orthogonal cross-sectional view, each of the first blades having a hub-side blade angle delta from a hub portion of the first impeller to a mid-span position of the first blade, the hub-side blade angle delta of each of the first blades varying along a streamwise direction such that the hub-side blade angle delta is largest at a first position closer to a leading edge of the first blade than to a trailing edge of the first blade;

a motor arranged inside the casing to rotate the shaft in order to rotate the first impeller, the casing being configured such that the low global warming potential (GWP) refrigerant enters the first impeller from the first inlet portion along an axial direction of the first impeller and exits the first impeller to the first outlet portion in a radial direction of the first impeller.

2. The centrifugal compressor according to claim 1, wherein the first position is located between 10% and 40% of a blade length of the first blade in the streamwise direction, where 0% corresponds to the leading edge and 100% corresponds to the trailing edge.

3. The centrifugal compressor according to claim 1, wherein the hub-side blade angle delta is in a range of 10 to 30 degrees at the first position.

4. The centrifugal compressor according to claim 1, wherein a hub-side wrap angle delta of each of the first blades from the hub portion to the mid-span position varies along the streamwise direction such that the hub-side wrap angle delta is largest at a second position closer to the leading edge than to the trailing edge.

5. The centrifugal compressor according to claim 4, wherein the leading edge of each of the first blades has a nonlinear shape when an inlet side of the first impeller is viewed along a direction parallel to the rotation axis.

6. The centrifugal compressor according to claim 1, wherein the first impeller is a closed type impeller including the hub portion and a shroud portion, the first blades being disposed between the hub portion and the shroud portion, and each of the first blades has a shroud-side blade angle delta from the mid-span position to the shroud portion, the shroud-side blade angle delta varying along the streamwise direction such that the shroud-side blade angle delta is largest at a third position closer to the leading edge of the first blade than to the trailing edge of the first blade.

7. The centrifugal compressor according to claim 6, wherein the shroud-side blade angle delta has a second peak disposed closer to the trailing edge than to the leading edge, the second peak being smaller than the largest shroud-side blade angle delta.

8. The centrifugal compressor according to claim 6, wherein the third position is located between 10% and 40% of a blade length of the first blade in the streamwise direction, where 0% corresponds to the leading edge and 100% corresponds to the trailing edge.

9. The centrifugal compressor according to claim 8, wherein the shroud-side blade angle delta is in a range of 6 to 14 degrees at the third position.

10. The centrifugal compressor according to claim 6, wherein a shroud-side wrap angle delta of each of the first blades from the mid-span position to the shroud portion varies along the streamwise direction such that the shroud-side wrap angle delta is largest at a fourth position closer to the leading edge than to the trailing edge.

11. The centrifugal compressor according to claim 1, wherein the trailing edge of each of the first blades has a positive rake angle.

12. The centrifugal compressor according to claim 1, further comprising a second impeller attached to the shaft, the second impeller being disposed between a second inlet portion and a second outlet portion of the casing, the second impeller being equipped with second blades, each of the second blades having a nonlinear shape in the quasi-orthogonal cross-sectional view, each of the second blades having a hub-side blade angle delta from a hub portion of the second impeller to a mid-span position of the second blade, the hub-side blade angle delta of each of the second blades varying along the streamwise direction such that the hub-side blade angle delta is largest at a fifth position closer to a leading edge of the second blade than to a trailing edge of the second blade.

13. The centrifugal compressor according to claim 12, wherein the first impeller and the second impeller are arranged back-to-back with the motor being disposed between the first impeller and the second impeller.

14. A method of producing refrigeration comprising:

compressing the low global warming potential (GWP) refrigerant within a chiller system that includes the centrifugal compressor according to claim 1.

15. The method according to claim 14, wherein the first impeller is a closed type impeller including the hub portion and a shroud portion, the first blades being disposed between the hub portion and the shroud portion.

16. The method according to claim 15, wherein a curvature of the fully nonlinear shape in the quasi-orthogonal cross-sectional-view varies along a length of the quasi-orthogonal cross-sectional view from the hub portion to the shroud portion.

17. A refrigeration circuit comprising:

the centrifugal compressor according to claim 1;

a condenser;

an expansion valve;

an evaporator; and piping connecting the centrifugal compressor, the condenser, the expansion valve, and the evaporator to form a loop, the refrigeration circuit containing the low global warming potential (GWP) refrigerant.

* * * * *